United States Patent [19]

Helinski

[11] Patent Number: 4,896,596

[45] Date of Patent: Jan. 30, 1990

[54] LUBRICATION SYSTEM FOR PRINT HAMMER MECHANISMS

[75] Inventor: Edward F. Helinski, Johnson City, N.Y.

[73] Assignee: International Business Machines Corporation, Armonk, N.Y.

[21] Appl. No.: 286,047

[22] Filed: Dec. 19, 1988

[51] Int. Cl.[4] ..... B41J 7/22; B41J 9/00

[52] U.S. Cl. ..... 101/93.48; 400/441; 74/519; 184/64; 384/383

[58] Field of Search ..... 400/441, 445, 445.3; 101/93.28, 93.29, 93.48; 74/519; 384/379, 382, 383; 184/64

[56] References Cited

U.S. PATENT DOCUMENTS

| | | | |
|---|---|---|---|
| 826,588 | 7/1906 | Mack | 384/382 |
| 851,201 | 4/1907 | Greening | 384/382 |
| 1,173,060 | 2/1916 | Talbott | 384/383 |
| 1,665,964 | 4/1928 | Koehler | 184/64 X |
| 1,784,732 | 12/1930 | Koehler | 184/64 |
| 2,452,771 | 11/1948 | La Rocque | 184/64 X |
| 2,674,134 | 4/1954 | Rigg | 74/519 |
| 2,751,264 | 6/1956 | Wood | 384/382 |
| 4,756,246 | 7/1988 | Kotasek | 101/93.48 |

*Primary Examiner*—Paul T. Sewell

*Attorney, Agent, or Firm*—Douglas M. Clarkson

[57] ABSTRACT

The disclosure describes a passive lubrication system for use in a high speed print hammer mechanism to provide continuous lubrication to all print hammer elements. Channels are formed along the length of a pivot pin and filled with a porous material having a finer porosity than the sintered print hammer block serving as the principal reservoir. Fins located at each side of print hammer elements also are of the same porosity as the print hammer block and communicate lubricant to the material in the pivot pin channels. From the channels, lubricant is conveyed to the interface between each print hammer element and the pivot pin by capillary action.

20 Claims, 2 Drawing Sheets

LUBRICATION SYSTEM FOR PRINT HAMMER MECHANISMS

BACKGROUND OF THE INVENTION

1. Field of the Invention

The present invention, generally, relates to print hammer mechanisms and, more particularly, to a passive lubrication system for use with the operating elements of print hammer mechanisms.

It has been found that, while use of sintered blocks, pins and other structures to provide reservoirs for lubricants permits a dramatic increase in the performance life of high speed print hammers, the lack of control over lubricant flow limits the scope of use for that form of lubrication system.

2. Description of the Prior Art

The prior art is rich with teachings of structures that concern lubricating bearing surfaces between metal parts having relative movement. However, special circumstances do not always lend themselves to these well known prior structures.

For example, with the advent of high speed printers as output devices for data processing equipment, problems have included the prevention of excessive wear between moving parts. Solutions that have been entirely satisfactory in one situation have proven to be entirely unsatisfactory in another, and this is especially true as the operating speeds of such high speed printers have increased to mind boggeling rates.

U.S. Pat. No. 4,756,246 to Kotasek et al. is assigned to the same Assignee as the present invention and describes the type of structural improvement that offers the advantage of increased operating life for these high speed printer mechanisms. Notwithstanding such advantage, however, the present invention permits a still further increase in the operating life of the print hammer modules because of advantages that accrue from the control over lubricant flow, which is obtained from the structure of the invention.

While this prior U.S. patent discloses some of the problems associated with the development of such high speed printers, it and none of the known prior patents and publications disclose or even suggest a solution such as that provided by the present invention. It is known now that the extremely high speeds at which these printer elements operate develop pressures on lubricant materials that are alternately positive and negative.

The use of sintered material structures as lubricant reservoirs and such material, as well as softer wick material, to convey the lubricant from the reservoirs to the area of need has become well known in the industry. However, none of these previously known arrangements permit control over the lubricant flow, and therefore, there has been no control over the rate of lubricant depletion.

OBJECTS AND SUMMARY OF THE INVENTION

It is a principal object of the present invention to provide a structural arrangement for high speed printer hammer mechanisms in which the rate of lubricant depletion is subject to predetermination.

Also, it is an important object of the invention to provide a measure of control over the direction of lubricant flow from the lubricant reservoir to the area of need that is particularly adaptable for use in high speed print hammer mechanisms.

Briefly, a structure in accordance with the present invention, in such a print hammer mechanism that has at least one print hammer element positioned between two fins with holes to receive a pivot pin for supporting the print hammer element, provides a lubricating system for lubricating the print hammer-pivot pin interface area. The lubricating system includes a reservoir for containing a supply of lubricant, and the pivot pin is formed with at least one channel extending longitudinally along its length. A porous wick material is located within the channel to convey lubricant from the reservoir to the print hammer-pivot pin interface area by capillary action.

The above and other objects, advantages and features of the present invention will become more readily apparent from the following detailed description of the presently preferred embodiment as illustrated in the accompanying drawings.

DETAILED DESCRIPTION OF THE INVENTION

Figure 1:
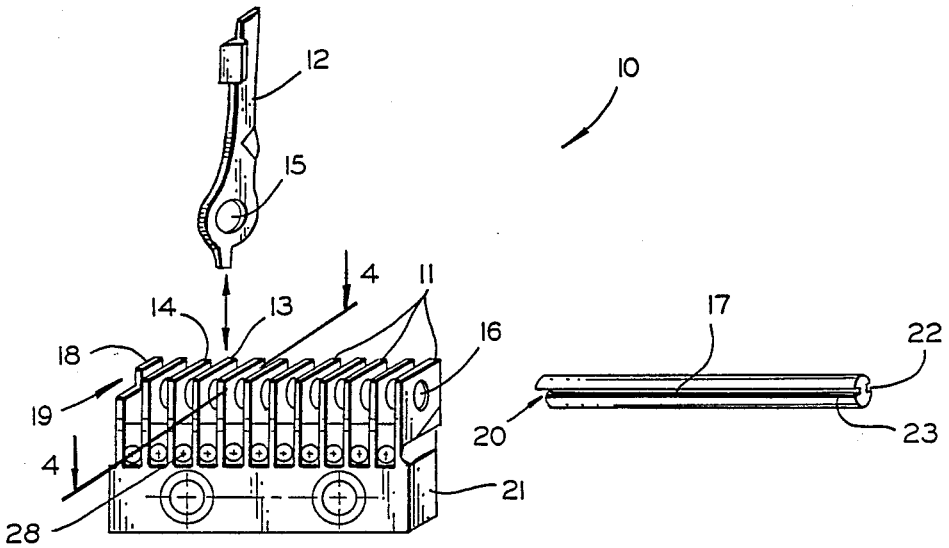
FIG. 1 is a perspective view of a print hammer mechanism that embodies the features of the invention.

In FIG. 1, a print hammer mechanism is identified generally by the reference numeral 10 as it is formed with the inventive structure. The print hammer mechanism 10 is characterized by a plurality of fins 11 arranged in a spaced apart relationship to receive a print hammer element 12 between two adjacent fins 11, as indicated by the particular print hammer element 12 between adjacent fins 13 and 14. Other print hammer elements, like the print hammer element 12, are located between each of the other adjacent ones of the fins 11.

The stem part of each print hammer element 12 has a hole 15 matching the holes 16 in each fin 11. A pivot pin 17 fits through the holes 16 in each fin 11 and the respective holes 15 in each print hammer element 12 to form support for each print hammer element. As shown in the particular print hammer mechanism illustrated, the last fin 18 is formed with a cut-out part 19 that matches the cut-out part 20 in the end of the pivot pin 17 to lock the pivot pin 17 from turning once it is in position for operation.

The reference numeral 21 identifies a hammer block that is formed of sintered material impregnated with lubricant to function as a reservoir. Actually, the entire block assembly, including the fins 11, is formed of lubricant impregnated sintered material.

The pivot pin 17 is formed with at least one channel extending longitudinally along the length of the pivot pin 17. The particular pivot pin 17 illustrated in FIG. 1 of the drawings is shown with two channels, identified as channels 22 and 23. This two channel construction is the preferred form because it gives better performance and life at the high speeds at which the print hammer mechanism 10 operates normally.

The longitudinal channels 22 and 23 each are filled with a relatively soft porous material (relative to the harder structural hammer block 21). Extensive testing has shown that the preferred orientation of the channels 22 and 23 is at a point of maximum bearing loading. Since the wick material in the channels bears against the print hammer elements 12, a relatively hard material would cause excessive wear and, for that reason alone, should be avoided.

Figure 2:
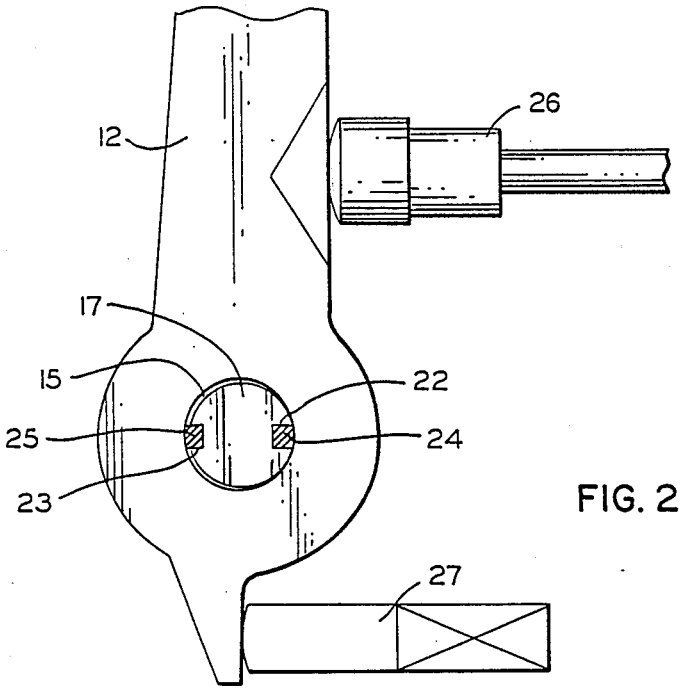
FIG. 2 is an enlarged view of the print hammer-pivot pin interface area to show the structure of the invention.

FIG. 2 of the drawings illustrates, in substantially enlarged form, the hole 15 in the print hammer element 12 as it is fitted on the pivot pin 17 with the two channels 22 and 23 filled with a soft porous material 24 and 25. In the operation of the print hammer element 12, an actuator device 26 pushes the print hammer element 12 against the action of a spring loaded pin device 27, all of which produces a pushing force against the pivot pin 17 within the hole 15.

However, tests have determined that the space (area) in the hole 15 around the pivot pin 17, as shown, can aid in the lubrication process, primarily from the material 24 that is located within the particular longitudinal channel 22. Also, the small space within the hole 15 around the pivot pin 17 together with the location of the channels 22 and 23 transverse to the longitudinal axis of the print hammer element 12, as shown in FIG. 2, provides the optimum in lubrication for the print hammer-pivot pin interface area.

Figure 3:
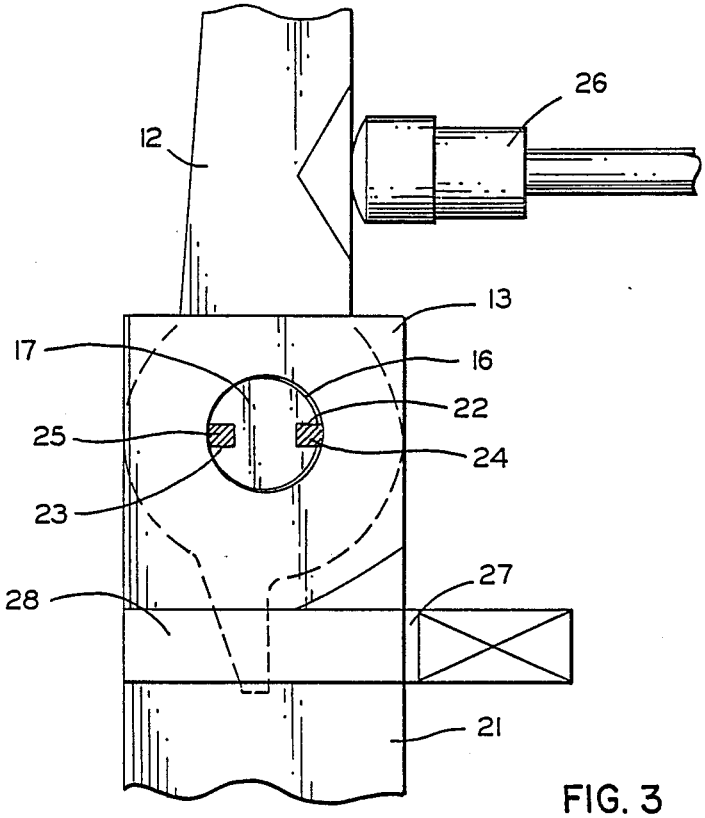
FIG. 3 is an enlarged view of the pivot pin support by an adjacent fin structure.

FIG. 3 of the drawings is similar to FIG. 2 but shows the pivot pin 17 as it is supported by an adjacent fin which, if the hammer element is identified as "12", then following the reference convention of FIG. 1, the fin in this view of FIG. 3 is identified by the numeral "13", and so, it is.

Therefore, as also illustrated in FIG. 1, each of the fins 11 is formed integrally with the hammer block 21 and of the same sintered material, so that lubricant will proceed by capillary action from the hammer block 21, to the fins 11, to the wick material 24 and 25 that is located within the channels 22 and 23, to lubricate the print hammer-pivot pin interface area, which is described above as the area in the hole 15 around the pivot pin 17.

As described in connection with FIG. 2 above, under the action of the actuator device 26 pushing against the print hammer element 12 against the action of the spring loaded pin device 27, the print hammer element 12 will exert more force on the wick 24 and that side of the pivot pin 17, FIG. 2, which urges the pivot pin 17 to the left, as viewed in FIG. 3. However, it should be noted that there is no relative movement of the pivot pin 17 within the hole 16 in the fin 13, and therefore, wear will be a minimum, both for the fin material and the wick material.

Figure 4:
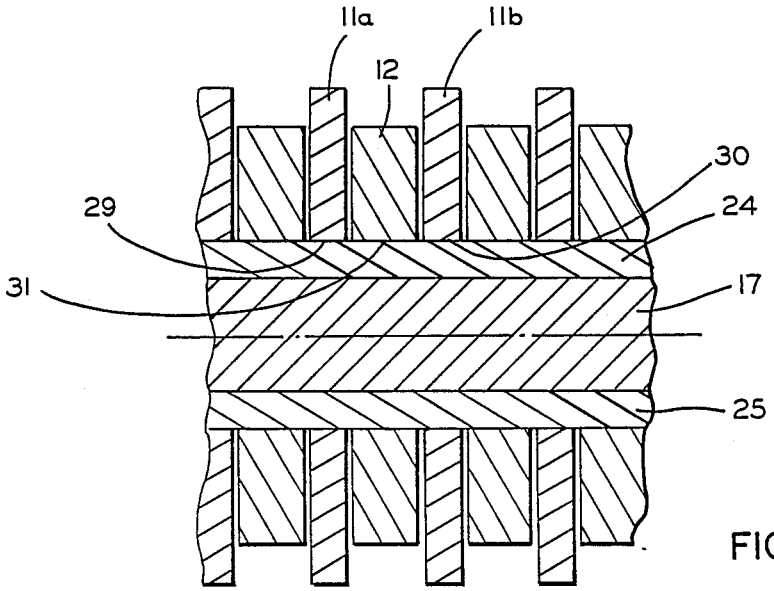
FIG. 4 is a horizontal sectional view of a portion of a multi-print-hammer arrangement supported by a single pivot pin and a plurality of fins with wick material that is located in surface channels on the pivot pin contacting the fins at a plurality of points, in accordance with one aspect of the invention.

Since the wick material 24 and 25 is in close, pressing contact with the sintered fin 13, and since the porosity of the wick material is finer than that of the fin 13, lubricant flow is urged from the fin 13 to the wick material 24 and 25 due to capillary forces. FIG. 4 of the drawings shows an arrangement utilizing a plurality of print hammer elements 12 supported by the same, single pivot pin 17 which, in turn, is supported by the respective fins located on each side of each print hammer element.

The significance of the view shown in FIG. 4 is to demonstrate more graphically an advantage of the structure of the invention. Note particularly how the wick material is in communication with the lubricant reservoir at a plurality of points.

For a structure involving only a single print hammer element, there are at least two fins, one positioned on each side of the print hammer element. This means that even with such a simple arrangement, the wick material in the surface channels on the pivot pin is in communication with the lubricant reservoir in two places.

This particular advantage of the invention is even more significant in multi-print-hammer-element mechanisms where all hammer elements must receive lubrication for the mechanism to remain operable for an extended period. This is the arrangement that is demonstrated by the view in FIG. 4.

Referring to FIG. 4 in particular, a portion of the structure of FIG. 1 is shown in plan view, generally along the line 4—4. The print hammer element 12 is shown, as described previously hereinabove, supported pivotally by the pivot pin 17 between two fins 11*a* and 11*b*.

The numerals 29 and 30 identify, respectively, the areas of communication between the fins 11*a*and 11*b*, and the numeral 31 identifies the print hammer-pivot pin interface area where the lubricant is needed. Therefore, by a structure in accordance with the present invention, the interface areas, like the area 31, along the pivot pin 17 are lubricated more nearly directly from the lubricant reservoir than with previous arrangements.

In the view illustrated in FIG. 3 of the drawings, the (return) spring loaded pin device 27 is located within an opening that is identified in both FIG. 1 and FIG. 3 by the reference numeral 28.

In any multi-print-hammer-element mechanism, such as that illustrated in FIG. 1, it is conceivable that print hammer elements in end locations would experience a depletion in lubricant first. This lack of sufficient lubrication in the interface area can produce a slowing in the response time for, first, the print hammer elements in the end locations. The "response time" is defined as the span of time between the energizing signal and impact of the print hammer element.

The depletion in lubrication for the print hammer elements has been associated directly with changes in the response time of the print hammer elements, and also, variations in porosity have been associated directly with such changes, because the porosity variations produce variations in flow of lubricant within the hammer block 21, FIG. 1. Further, it has been found that it is a hydrodynamic action, which sustained printing develops, that produces a more rapid depletion of lubricant, particularly at the end locations as compared with locations more internal of the print hammer mechanism.

A depletion of lubricant due to this cause will exhibit a replenishing affect during a sufficiently long down time without printing. However, for an arrangement in accordance with the present invention, it is important that the channels 22 and 23 be located on the surface of the pivot pin 17 where the softer porous material 24 and 25 touches both the fins 11 and the print hammer element.

In accordance with the present invention, the sintered hammer block 21, in its presently preferred arrangement, is formed using PMB 13 powder from SCM Corporation to provide the blended bronze alloy sintered hammer block with a density in the order of 6.5 grams per cubic centimeter. Actually, the threshold to achieve an acceptable density for optimum operating performance is a density within the range of about 6.5 to 7.0 grams per cubic centimeter.

Also with the presently preferred arrangement, the longitudinal slots 22 and 23 in the pivot pin 17 are filled with a material, such as high density Scott felt, having pores that are equal to or slightly finer than those of the sintered hammer block 21. A reason for this preference is a control over the direction of flow for the lubricant. In other words, having slightly finer pores in the material 24 and 25 located within the channels 22 and 23 ensures that, as lubricant in the hammer block 21, being a reservoir in this structure, is depleted with time and usage, lubricant in the print hammer-pivot pin interface area will not flow backwards to the reservoir.

Not only is the above-described passive lubrication system just as effective as some of the active systems in use today, it is far more economical. There is provided for the first time, a passive lubrication system for a print hammer-pivot pin interface area to ensure continuous lubrication of the print hammer-pivot pin interface area.

The invention has been shown, described and illustrated in substantial detail with reference to a presently preferred embodiment. It will be understood by those skilled in this art that changes may be made without departing from the spirit and scope of the invention which is set forth in the claims appended hereto.

What is claimed is:

1. In a print hammer mechanism, the combination comprising:

elongated pivot pin means to form a support for at least one print hammer element;

at least two fins spaced apart and having means to define openings to receive said pivot pin means;

a print hammer element having a stem portion with means to define an opening to receive said pivot pin means for supporting said print hammer element in a position between said fins; and a lubrication system for lubricating said print hammer element while in said position of support by said pivot pin means, comprising:

reservoir means for containing a supply of lubricant;

means on said pivot pin means to define a channel extending longitudinally of said pivot pin means; and porous means in said channel for conveying lubricant by capillary action from said reservoir means to said print hammer element.

2. A lubrication system in a print hammer mechanism as defined in claim 1 wherein said means to define a channel on said pivot pin means includes means to define two channels; and both of said channels having porous means located therein for conveying lubricant by capillary action from said reservoir means to said print hammer element.

3. A lubrication system in a print hammer mechanism as defined in claim 1 including block means formed of a sintered material; said fins being formed integrally with said block means and of the same sintered material; both said block means and said fins being impregnated with lubricant to function as said reservoir for said lubrication system.

4. A lubrication system in a print hammer mechanism as defined in claim 1 wherein said mechanism includes means to actuate said print hammer element along a predetermined line and means acting against said print hammer element to return said print hammer to a retracted, non-printing position; and said channels being located along a line generally perpendicular to said predetermined line.

5. A lubrication system in a print hammer mechanism as defined in claim 1 wherein said porous means located within said channel has a finer porosity than the porosity of said block means and fins, so that the direction of flow of said lubricant is toward said print hammer element.

6. A lubrication system in a print hammer mechanism as defined in claim 5 wherein said density of said porous material of which said block means and fins are formed is within the range of 6.5 to 7.0 grams per cubic centimeter.

7. A lubrication system in a print hammer mechanism as defined in claim 5 wherein said density of said porous material forming said block and fins is at least 6.5 grams per cubic centimeter.

8. A lubrication system in a print hammer mechanism as defined in claim 6 wherein said block and fins are formed of blended bronze alloy.

9. A lubrication system in a print hammer mechanism as defined in claim 6 including a plurality of print hammer elements and a plurality of fins, one print hammer element being located between adjacent fins, and said finer porosity of said material in said channels than the porosity of said block ensuring a flow of lubricant to said print hammer elements, particularly to print hammer elements located at an end position of said plurality of print hammer elements.

10. A lubrication system in a print hammer mechanism as defined in claim 1 including means to lock said elongated pivot pin means against rotation.

11. A lubrication system in a print hammer mechanism having, in combination:

elongated pivot pin means to form a support for a plurality of print hammer elements and having a predetermined length;

means on said elongated pivot pin means to define two channels extending substantially the length of said elongated pivot pin means in a predetermined location;

a plurality of fins arranged in a predetermined spaced apart relationship to receive a print hammer element between adjacent fins;

reservoir means for containing a supply of lubricant;

said plurality of fins being formed of a porous material to receive a flow of said lubricant from said reservoir means; and wick material in each of said two channels and having a porosity limited to that of said porous material forming said plurality of fins;

whereby said wick material is in communication with each of said plurality of fins in a plurality of locations for ensuring lubricant availability to an area on said elongated pivot pin means at which a print hammer element is supported.

12. A lubrication system in a print hammer mechanism as defined in claim 11 wherein said mechanism includes means to actuate each of said plurality of print hammer elements along a predetermined line; and said two channels being located along a line generally perpendicular to said predetermined line.

13. A lubrication system in a print hammer mechanism as defined in claim 11 wherein said plurality of fins is formed of blended bronze alloy having a predetermined density.

14. A lubrication system in a print hammer mechanism as defined in claim 13 wherein said predetermined density of said plurality of fins is at least 6.5 grams per cubic centimeter.

15. A lubrication system in a print hammer mechanism as defined in claim 13 wherein said predetermined density of said plurality of fins is within the range of 6.5 to 7.0 grams per centimeter.

16. A passive lubrication system for use in a mechanism having at least one element of a predetermined length supported to be pivoted at high speed over a very small angle, comprising:

elongated pivot pin means to support said one element and having a predetermined length;

at least two means having means to define an opening to receive said elongated pivot pin means, one of said means located on each side of said one element, and having means to define at least one channel extending along said predetermined length;

porous means located within said channel and extending out therefrom to be in communication with said two means; and reservoir means for containing a supply of a predetermined lubricant and including means forming a path for lubricant flow from said reservoir means to said two means;

whereby lubricant flow by capillary action occurs readily from said reservoir means, through said two means, and through said porous means to lubricate an area of support between said elongated pivot pin means and said one element.

17. A passive lubrication system as defined in claim 16 wherein said two means each has a predetermined density, and said porous means has a density at least equal to said predetermined density.

18. A passive lubrication system as defined in claim 16 wherein said channel extends in a direction generally perpendicular to said predetermined length of said one element.

19. A passive lubrication system as defined in claim 16 including a plurality of said one elements of a predetermined length, a plurality of said two means, one on each side of each one element, and said porous means being in communication with said reservoir means in a plurality of places.

20. A passive lubrication system as defined in claim 17 wherein said predetermined density of said two means is within the range of 6.5 to 7.0 grams per cubic centimeter.

* * * * *